US011679480B2

(12) United States Patent
Peng et al.

(10) Patent No.: US 11,679,480 B2
(45) Date of Patent: Jun. 20, 2023

(54) NOSEPIECE LATCH MECHANISM FOR A FASTENING TOOL

(71) Applicant: Black & Decker, Inc., New Britain, CT (US)

(72) Inventors: Wei-Chih Peng, Taichung (TW); Yao-Te Yang, Taichung (TW)

(73) Assignee: Black & Decker, Inc., New Britain, CT (US)

( * ) Notice: Subject to any disclaimer, the term of this patent is extended or adjusted under 35 U.S.C. 154(b) by 234 days.

(21) Appl. No.: 16/889,918

(22) Filed: Jun. 2, 2020

(65) Prior Publication Data

US 2020/0290191 A1 Sep. 17, 2020

Related U.S. Application Data

(63) Continuation of application No. PCT/US2018/064436, filed on Dec. 7, 2018.

(60) Provisional application No. 62/595,739, filed on Dec. 7, 2017.

(51) Int. Cl.
*B25C 5/16* (2006.01)
*B25C 1/04* (2006.01)

(52) U.S. Cl.
CPC ..... *B25C 5/1675* (2013.01); *B25C 1/047* (2013.01)

(58) Field of Classification Search
CPC ..... B25C 1/00; B25C 1/001; B25C 1/005; B25C 1/008; B25C 1/188; B25C 7/00; B25C 5/1603; B25C 5/1689; B25C 5/1665
See application file for complete search history.

(56) References Cited

U.S. PATENT DOCUMENTS

| | | | | |
|---|---|---|---|---|
| 4,436,236 | A | 3/1984 | Jobe | |
| 4,467,952 | A | 8/1984 | Morrell | |
| 6,076,722 | A | 6/2000 | Huang | |
| 6,318,618 | B1 | 11/2001 | Jen | |
| 6,598,776 | B2 | 7/2003 | Adachi et al. | |
| 6,651,862 | B2 | 11/2003 | Driscoll et al. | |
| 6,786,380 | B2 | 9/2004 | Driscoll et al. | |
| 7,032,796 | B1 * | 4/2006 | Lin | B25C 5/1665 227/123 |
| 7,213,732 | B2 | 5/2007 | Schell et al. | |
| 7,320,422 | B2 | 1/2008 | Schell et al. | |
| 7,431,103 | B2 | 10/2008 | Schell et al. | |
| 7,641,089 | B2 | 1/2010 | Schell et al. | |
| 7,845,530 | B2 | 12/2010 | Schell et al. | |
| 8,006,883 | B2 | 8/2011 | Schell et al. | |

(Continued)

FOREIGN PATENT DOCUMENTS

| | | |
|---|---|---|
| EP | 1 260 321 B1 | 3/2010 |
| JP | 4219742 B2 | 2/2009 |

(Continued)

OTHER PUBLICATIONS

Extended European Search Report, dated Jul. 9, 2021, for corresponding EP application No. 18886199.1-1017/3720658.

*Primary Examiner* — Chelsea E Stinson
(74) *Attorney, Agent, or Firm* — Rhonda Barton

(57) ABSTRACT

A fastening tool having a latch mechanism that performs a tool-free jam release of a jammed fastener in the nosepiece. The latch mechanism includes a latch plate that is secured to the nose portion of a nosepiece assembly by a latch member and is pivotably releasable from the nose portion by a user's fingers.

18 Claims, 10 Drawing Sheets

(56) References Cited

U.S. PATENT DOCUMENTS

| | | | | |
|---|---|---|---|---|
| 8,556,148 | B2 * | 10/2013 | Schell | B25C 5/1689 227/123 |
| 8,690,036 | B2 | 4/2014 | Schell et al. | |
| 9,469,021 | B2 | 10/2016 | Gregory et al. | |
| 9,486,904 | B2 | 11/2016 | Gregory et al. | |
| 9,498,871 | B2 | 11/2016 | Gregory et al. | |
| 9,643,305 | B2 | 5/2017 | Gregory et al. | |
| 9,649,755 | B2 | 5/2017 | Gregory et al. | |
| 9,827,658 | B2 | 11/2017 | Gregory et al. | |
| 2002/0030079 | A1 | 3/2002 | Michiaki et al. | |
| 2002/0104868 | A1 * | 8/2002 | Miller | B25C 1/045 227/8 |
| 2002/0117531 | A1 | 8/2002 | Schell et al. | |
| 2003/0062394 | A1 | 4/2003 | Wang | |
| 2006/0091176 | A1 | 5/2006 | Cannaliato et al. | |
| 2006/0191973 | A1 | 8/2006 | Chen et al. | |
| 2009/0263187 | A1 | 10/2009 | Lee | |
| 2012/0228354 | A1 * | 9/2012 | Schwartzenberger | B25C 1/188 227/123 |
| 2013/0320063 | A1 | 12/2013 | Gregory et al. | |
| 2013/0320064 | A1 | 12/2013 | Gregory et al. | |
| 2017/0036333 | A1 | 2/2017 | Lin | |
| 2017/0095916 | A1 | 4/2017 | Lin | |
| 2019/0077000 | A1 * | 3/2019 | Hung | B25C 1/043 |
| 2020/0398414 | A1 * | 12/2020 | Peng | B25C 1/047 |

FOREIGN PATENT DOCUMENTS

| | | | | |
|---|---|---|---|---|
| JP | 6183071 | B2 | 8/2017 | |
| TW | 201914772 | A * | 4/2019 | B25C 1/008 |

* cited by examiner

NOSEPIECE LATCH MECHANISM FOR A FASTENING TOOL

CROSS-REFERENCE TO RELATED APPLICATIONS

The present application is a continuation of international application PCT/US2018/064436 filed on Dec. 7, 2018 which claims priority under 35 U.S.C. § 119 to U.S. Provisional Patent Application Ser. No. 62/595,739 filed on Dec. 7, 2017, which is herein incorporated by reference in its entirety.

BACKGROUND OF THE INVENTION

Field of the Invention

The present invention relates, in general, to the field of power tools. In particular, the present invention relates to a fastening or driving tool, such as a nailer and more particularly to improvements in such tools for clearing the fastener drive track of a jammed fastener.

Description of the Related Art

Different types of fastening tools are known including portable pneumatically actuated devices, electrically actuated devices, hammer actuated devices, manual actuated devices, etc. Fastening tools, such as power nailers have become relatively common place in the construction industry. Pneumatically-powered nailers, which are connected to an air compressor via an air hose, are popular in the market.

A common characteristic of all these types of fastening tools is the provision of a drive track, a fastener driving element mounted in the drive track and a magazine assembly for receiving a supply of fasteners in stick formation and feeding successive leading fasteners in the stick laterally into the drive track to be driven outwardly thereof by the fastener driving element. Several different types of magazine assemblies are known. These assemblies are usually designated by the manner in which they are loaded such as bottom loaders, front loaders, rear loaders and top loaders. Rear and top loaders are quite popular because of their simplicity of construction and operation. One disadvantage of each of these assemblies is that the drive track is normally defined by a fixed structure and therefore, unless a movable drive track access part is provided, clearing of fasteners, which become jammed in the fastener drive track is difficult.

Accordingly, there is a need in the art for a nailer that is capable of reliably allowing a user to remove a jammed fastener from the fastener drive track in the nosepiece assembly with their fingers and without the use of tools.

SUMMARY OF THE INVENTION

In an embodiment, the present invention is directed to a fastening tool including a housing and a nosepiece assembly carried by the housing. The nosepiece assembly includes a nose portion having first end adjacent to the housing and a second end opposite to the housing. A pair of hooks are integrally formed on the nose portion. A door is arranged opposite the nose portion and a fastener drive track is disposed between the nose portion and the door. The fastening tool also includes a magazine for feeding fasteners successively to the fastener drive track of the nosepiece assembly. An engine is provided and carried by the housing. The engine is configured to drive a fastener out of the fastener drive track and into a workpiece during a drive stroke. The fastening tool also includes a latch mechanism designed to provide a tool-free access to the nosepiece for, among other purposes, cover the nosepiece assembly and provide access to the fastener drive track between the nose portion and the door in order to remove a jammed fastener. The latch mechanism includes a latch cover, a latch plate disposed between the latch cover and the door, and a latch member connecting the latch plate to the latch cover.

In an embodiment, the pair of hooks on the nosepiece are disposed on opposite lateral sides of the nose portion and open toward the housing. Toward the forward end of the nosepiece assembly, the door is disposed between the pair of hooks. One end of the door adjacent to the housing is sandwiched between a door plate mounted on the nose portion and the nose portion. The door is pivotably and slidably movable with respect to the nose portion.

The latch mechanism is disposed along the longitudinal length of the nosepiece assembly and arranged to cover at least a portion of the nosepiece assembly. The latch mechanism has a latched position and an unlatched position. In the latched position of the latch mechanism, the latch member engages the pair of hooks and in the unlatched position, the latch member is disengaged from the pair of hooks. In the latched position, the latch member exerts an outward force against the pair of hooks in the direction toward the second end of the nose portion so as to create a compressive stress on the latch mechanism.

In an embodiment, the latch member is formed from a wire. The wire can be formed from a metal material, such as steel.

In an embodiment, the latch plate includes a pair of forward flanges through which the latch member connects the latch plate to the latch cover and a pair of rear flanges for pivotably connecting the latch plate to the door plate.

In an embodiment, the latch cover can be formed as a rigid body and can include a first material and a second material different from the first material. At least one of the first material and second material can be plastic. Alternatively, the rigid body can be formed from metal alone.

The latch cover can further include gripping section for facilitating movement of the latch mechanism from the latched position to the unlatched position.

BRIEF DESCRIPTION OF THE DRAWINGS

The numerous advantages of the present invention may be better understood by those skilled in the art by reference to the accompanying Figures. In the drawings, like reference numerals designate corresponding parts throughout the several views.

Corresponding reference numerals indicate corresponding parts throughout the several views of the drawings.

DETAILED DESCRIPTION OF THE INVENTION

Figure 1:
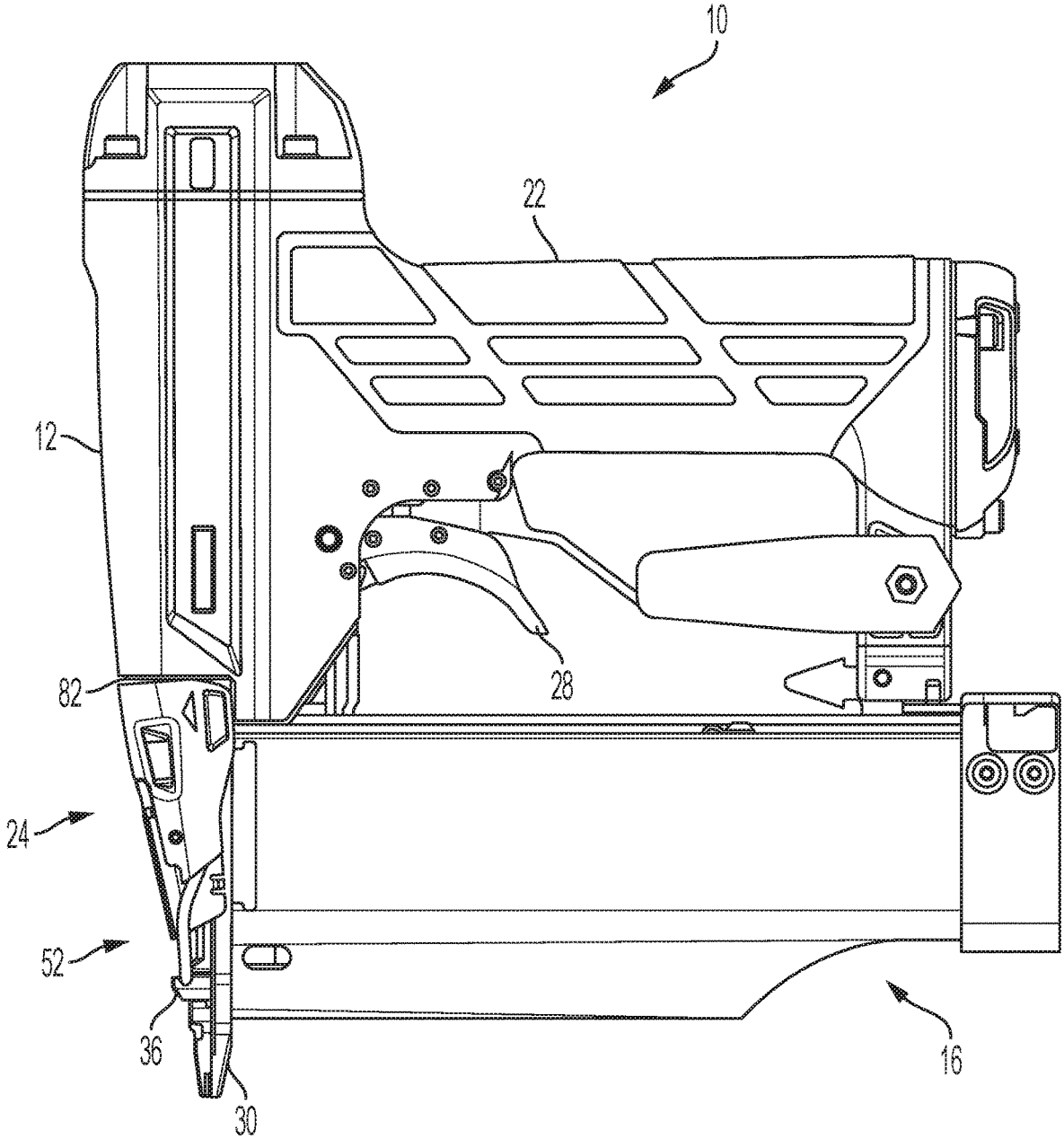
FIG. 1 is a side view of an exemplary fastening tool constructed in accordance with the teachings of the present disclosure and showing a latch mechanism in a latched position.
Figure 2:
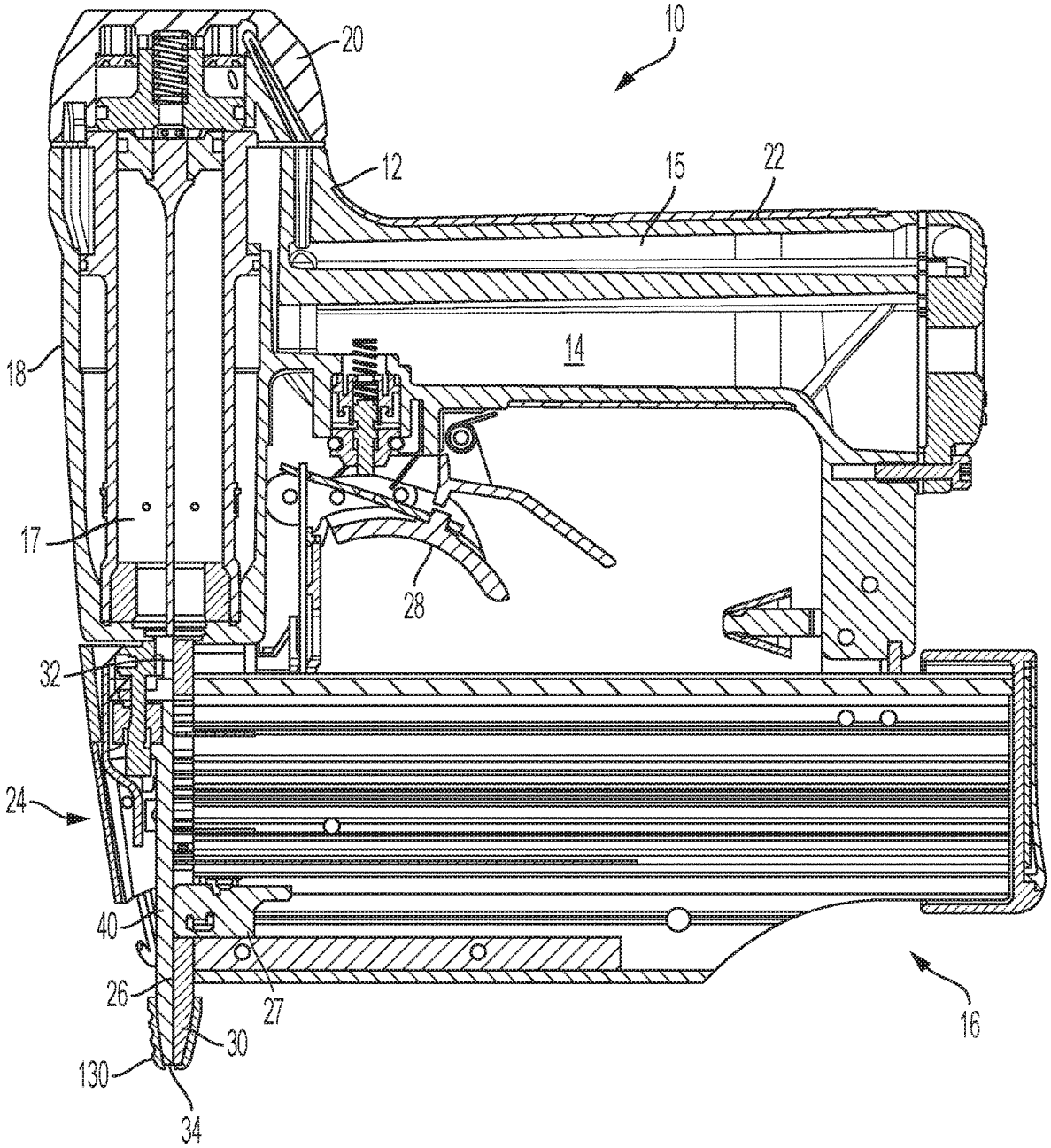
FIG. 2 is a cross-sectional view of the fastening tool of FIG. 1.

FIGS. 1 and 2 illustrate a fastening tool 10 according to an embodiment of the invention.

According to several aspects, the fastening tool 10 is a pneumatically powered nailer, however the fastening tool 10 can be any type of portable tool including a battery operated nailer. The fastening tool 10 includes a housing 12, a nosepiece assembly 24 fixed to the housing 12 and a magazine assembly 16 operatively connected to both the magazine and the nosepiece assembly.

The housing 12 contains components including a pressurized gas reservoir 14, and engine 17 for driving a fastener into a workpiece. The housing 12 defines a reservoir 14 therein. The reservoir 14 is configured to receive a pressurized gas that is used to power the fastening tool 10. In an embodiment, the pressurized gas may be provided to the reservoir 14 from a compressor through a hose. The hose may be connected to the fastening tool 10 via a fitting (not shown) that may be attached to the housing 12. Alternatively, the pressurized gas may be provided to the reservoir 14 through a cartridge. In an embodiment, the pressurized gas may be air that has been compressed by a compressor, as is commonly used in pneumatic tools. It is also contemplated that any gas that releases energy upon expansion, such as a gas produced as a by-product of combustion, or a gas that is produced upon a phase transformation of a liquid, such as carbon dioxide may also be used to power the fastening tool 10. The illustrated embodiment is not intended to be limiting in any way.

As illustrated, the housing 12 includes an engine receiving portion 18 and a cap 20 that is connected to the engine receiving portion 18 at one end. The housing 12 also includes a handle portion 22 that extends from the engine receiving portion 18. As shown, the handle portion 22 may extend substantially perpendicularly from the engine receiving portion 18. The handle portion 22 is configured to be received by a user's hand, thereby making the fastening tool 10 portable. The housing 12 provides a trigger assembly 28 for actuating operation of the fastening tool 10. The housing 12 may be constructed from a lightweight yet durable material, such as magnesium.

The reservoir 14 is substantially defined by the handle portion 22, although it is contemplated that a portion of the reservoir 14 may also be defined by the engine receiving portion 18. In an embodiment, the handle portion 22 may also include a second reservoir 15 that is configured to be open to atmosphere and is configured to allow exhaust gas to exit the fastening tool 10 through the handle portion 22.

Figure 3:
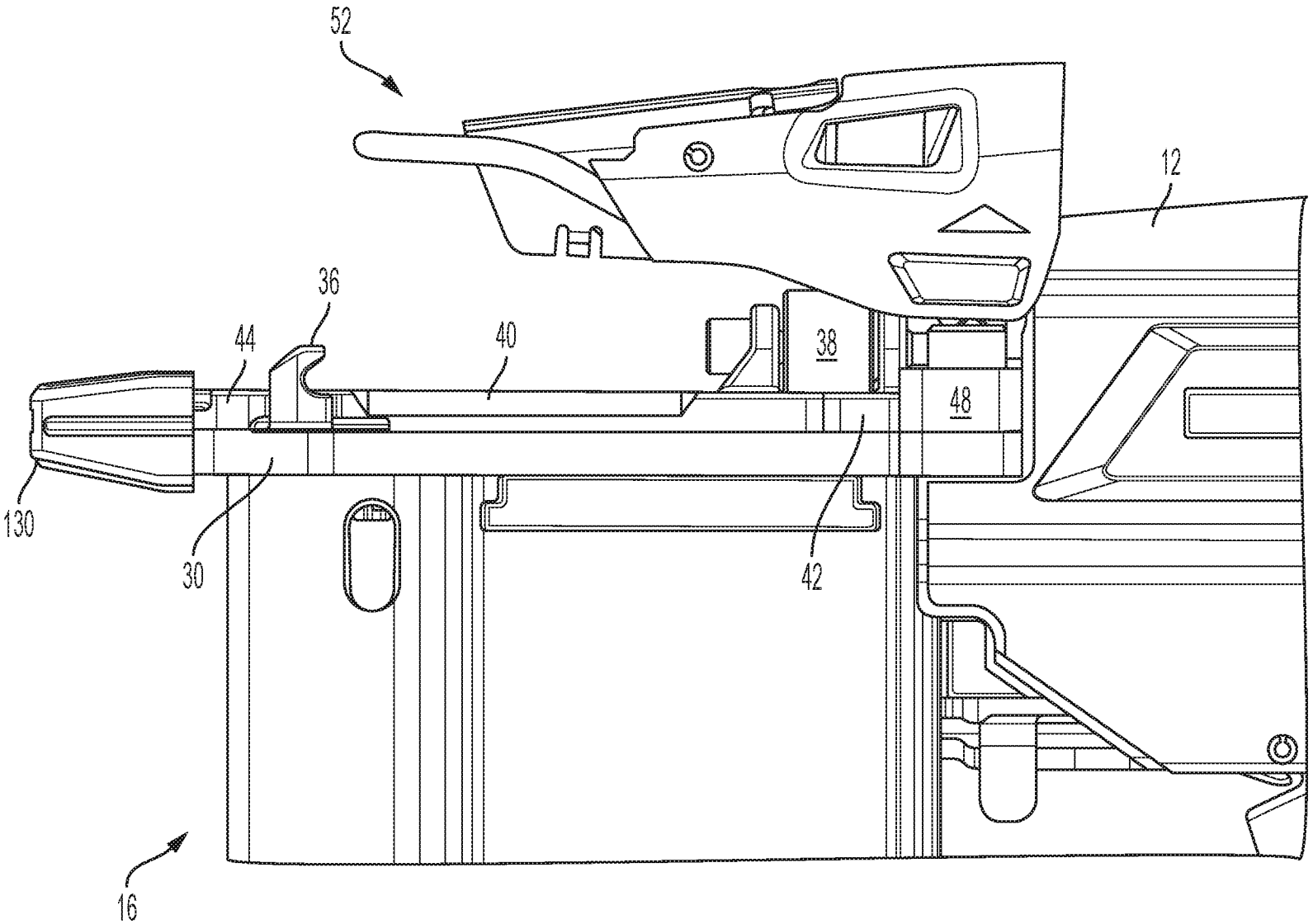
FIG. 3 is a side view of the nosepiece assembly of the fastening tool of FIG. 1.
Figure 4:
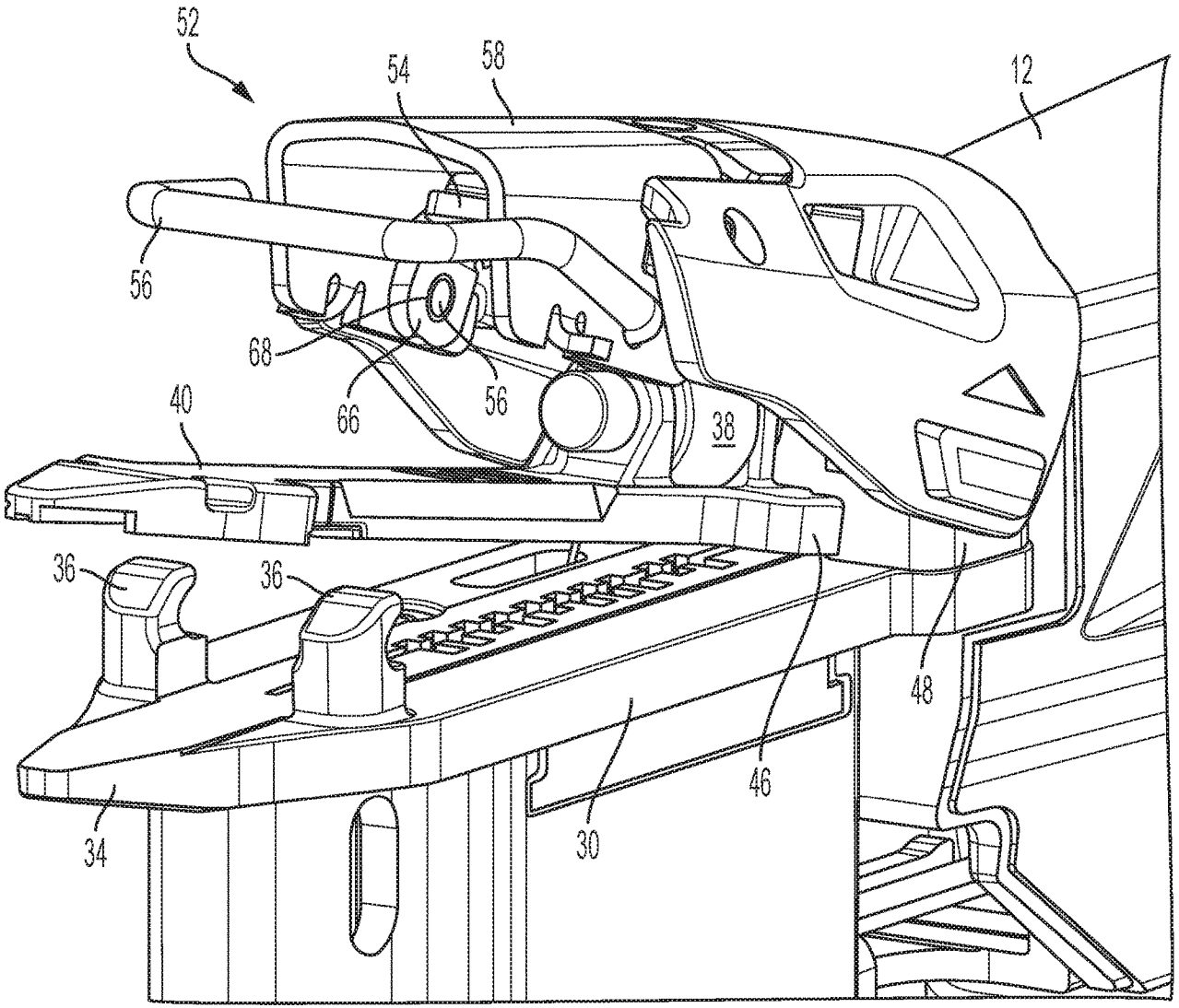
FIG. 4 is a side perspective view of the nosepiece assembly of the fastening tool of FIG. 1.

As illustrated in FIGS. 2, 3 and 4, the fastening tool 10 also includes a nosepiece assembly 24 that defines a fastener drive track 26 and through which fasteners, such as nails, are driven. The nosepiece assembly 24 extends forward of and is connected to both the housing 12 and the magazine assembly 16. The nosepiece assembly 24 includes a nose portion 30 mounted to a backbone structure (not shown) within the housing 12. The nose portion 30 has an elongated body with a longitudinal length that extends between a first end 32 adjacent to the housing 12 and an opposite or second end 34. The second end of the nose portion 30 is a nose tip that can support a no mar tip 130. The no mar tip 130 protects the workpiece surface from indentations caused by the tip or fastener ejection end of the nosepiece assembly on the workpiece when a fastener is driven. The no mar tip can be formed from a resilient material.

The nosepiece assembly 24 also includes a pair of hooks 36 that project outward from a surface of the nose portion 30. The pair of hooks can be integrally formed with the nose portion 30. The hooks 36 are disposed on opposite lateral sides, such as, arranged laterally across the nose portion and can be open or curved toward the housing 12. As such, the hooks can have a concave profile facing the housing. The hooks 36 serve to engage a portion of the latching mechanism in a latched position.

Figure 10:
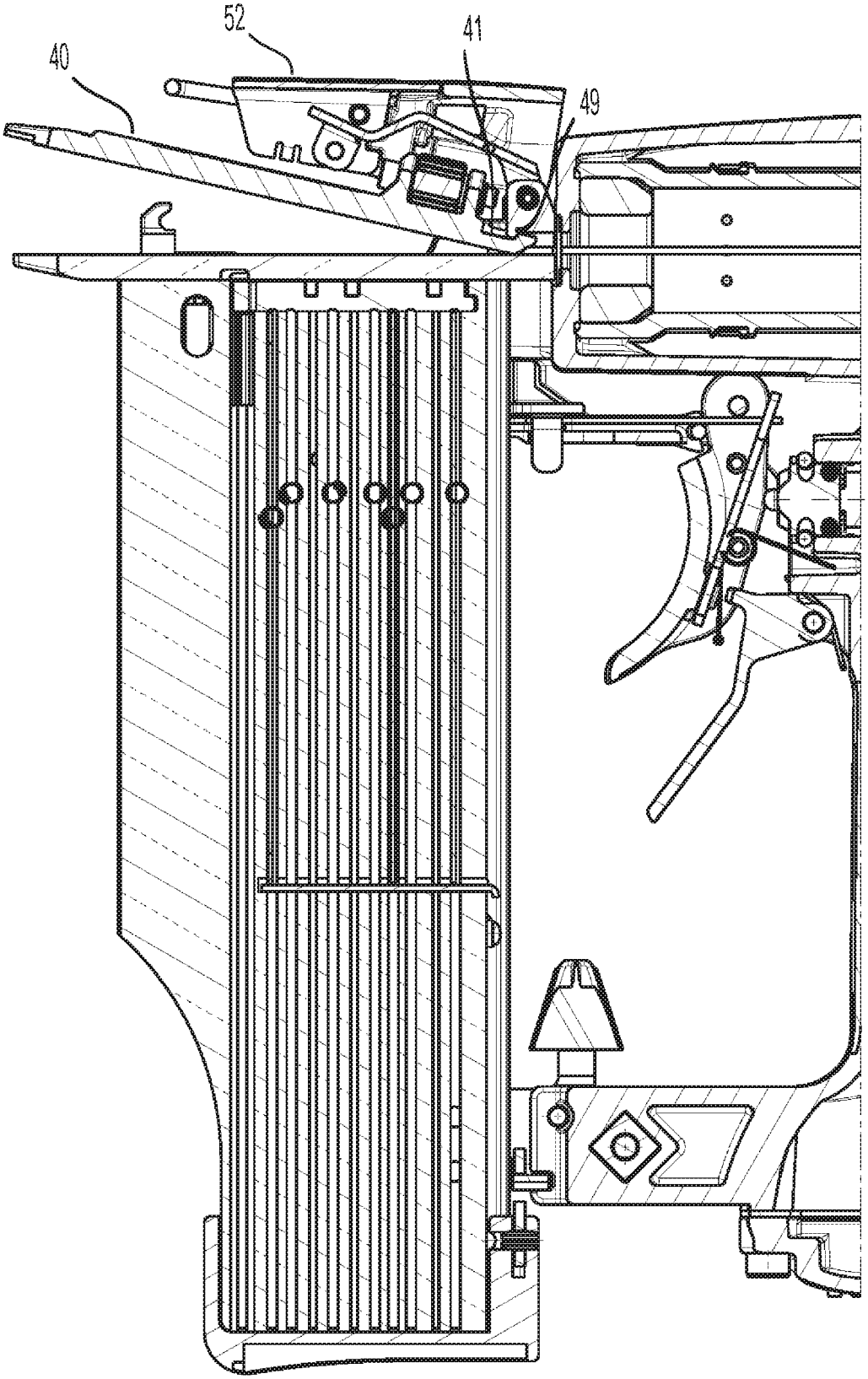
FIG. 10 is a cross-sectional side view of the nosepiece assembly with the latch mechanism in an unlatched position.

A pivoting door 40 is arranged along the longitudinal length of the nose portion 30 between the laterally arranged pair of hooks 36. The door 40 has a rigid body and provides a platform on which a depth adjustment wheel 38 can be mounted. The door 40 has a proximal end 42 adjacent to the housing 12, a distal end 44 that can engage the no mar tip 130, and laterally projecting flanges 46. The proximal end 42 of the door 40 is sandwiched between a door plate 48 and the nose portion 30. The proximal end 42 of the door 40 includes a lateral groove 41 (FIG. 10) in which a projecting lip 49 of the door plate 48 sits. The projecting lip 49 provides forward and rearward limits on the distance that the door 40 can slide in order to correspond to the selected depth defined by the depth adjustment wheel 38. The door 40 also pivots about the projecting lip 49 of the door plate 48 so that the door can open with respect to the nose portion 30 for the removal of a jammed fastener.

A resilient stop member 50 (See also FIG. 7) projects from an aperture in the nose portion 30 toward the proximal end 42 of the door 40. The stop member 50 engages at least one of a pair of flanges 46 projecting laterally from the proximal end 42 of the door 40. The stop member 50 prevents the door 40 from moving longitudinally beyond a predetermined distance and becoming dislodged from the nosepiece assembly 24. The resilient stop member can be a U-shaped spring.

In combination, the nose portion 30 and the door 40 define the fastener drive track through which fasteners pass from the magazine assembly 16 to the ejection end of the nosepiece assembly 24.

Fasteners are temporarily contained in the magazine assembly 16 which can be connected to the nosepiece assembly 24 for feeding individual fasteners from the magazine assembly to the nosepiece assembly. The magazine assembly 16 is constructed and arranged to feed successive leading fasteners from a supply of fasteners contained therein along a feed track and into the drive track 26. The supply of fasteners is urged toward the drive track 26 by a pusher 27 that is biased towards the drive track 26 and engages the last fastener in the supply of fasteners. Although the illustrated magazine assembly 16 is configured to receive fasteners that are collated in a stick configuration, it is also contemplated that a magazine assembly that is configured to accommodate fasteners that are collated in a coil formation may also be used. The illustrated embodiment is not intended to be limiting in any way.

The fastening tool includes a tool-free jam release system in the form of a latch mechanism 52. The latch mechanism 52 is operatively connected to the nosepiece assembly 24 in both a latched position and an unlatched position. As shown in FIG. 2, the latch mechanism 52 is in a latched position. In the latched position, the latch mechanism 52 is disposed along the longitudinal length of the nosepiece assembly 24 and arranged to cover at least a portion of the nosepiece assembly. A portion of the latch mechanism 52 also engages the concave portion of the pair of hooks 36 on the nose position 30. Although a pair of hooks are illustrated other arrangement of holding members including a single holding member are contemplated to engage the latch member 56.

As shown in FIG. 3, the latch mechanism is in an unlatched position. In the unlatched position, the latch mechanism 52 is disengaged from the pair of hooks 36. As a result, the door 40 can be accessed and opened to remove jammed fasteners from the nosepiece assembly 24.

Figure 5:
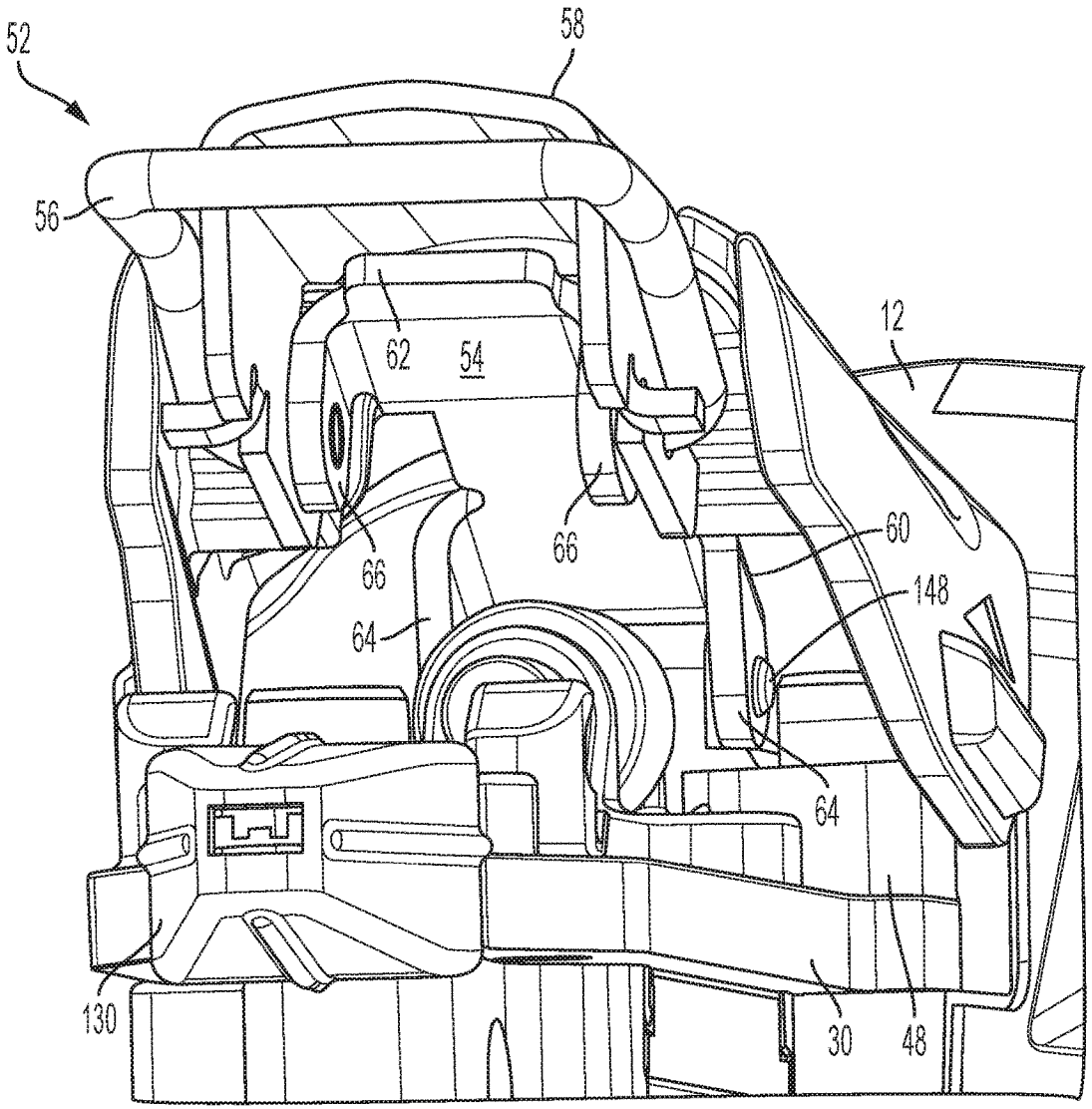
FIG. 5 is a front perspective view of the nosepiece assembly and latch mechanism of the fastening tool of FIG. 1.

As best illustrated in FIGS. 4 and 5, the latch mechanism 52 includes a latch plate 54, a latch member 56 in the form of a latch wire or clip, and a latch cover 58.

The latch plate 54 is disposed within a recess defining the underside of the latch cover 58. The latch plate 54 is an elongated body having a first end 60 and an opposite second end 62 and two pairs of orthogonally projecting or depending rear flanges 64 and forward flanges 66. The pair of depending rear flanges 64 is arranged at the first end 60 of the latch plate 54 and the pair of depending forward flanges 66 is arranged at the second end 62 of the latch plate 54. The flanges 64, 66 are disposed on opposite lateral sides and project from a side of the latch plate 54 opposite the latch cover 58. The first end 60 of the latch plate 54 is pivotally connected to the door plate 48 by a pin 148 that passes through an aperture in each of the pair of projecting flanges. The pin 148 has an axis perpendicular to a drive axis and allows the latch plate 54 to be pivotable toward and away from the nose portion 30 and the door 40. Each of the pair of forward projecting flanges 66 on the second end 62 of the latch plate 54 have apertures 68 through which the latch member 56 is connected thereto. The latch plate 54 has a non-linear profile that creates a space below the latch plate for the depth adjustment wheel 38.

The latch member 56 projects forwardly from the latch plate 54, toward the second end 34 of the nose portion 30 in order to engage the pair of hooks 36. In the latched position, the latch member 56 engages the hooks 36 to secure the latch mechanism 52 on the nose portion 30. In this position, the latch member 56 further exerts or transmits an outward force against the pair of hooks 36 in the direction toward the second end 62 of the nose portion 30. Engagement of the latch member 56 and the pair of hooks 36 creates a compressive stress on the latch mechanism 52.

In the unlatched position, the latch member 56 is disengaged from the pair of hooks 36. The latch member 56 can have a U-shape and be formed from a metal, such as, for example, steel. Although a pair of hooks are illustrated other arrangement of holding members including a single holding member are contemplated to engage the latch member 56.

Figure 6:
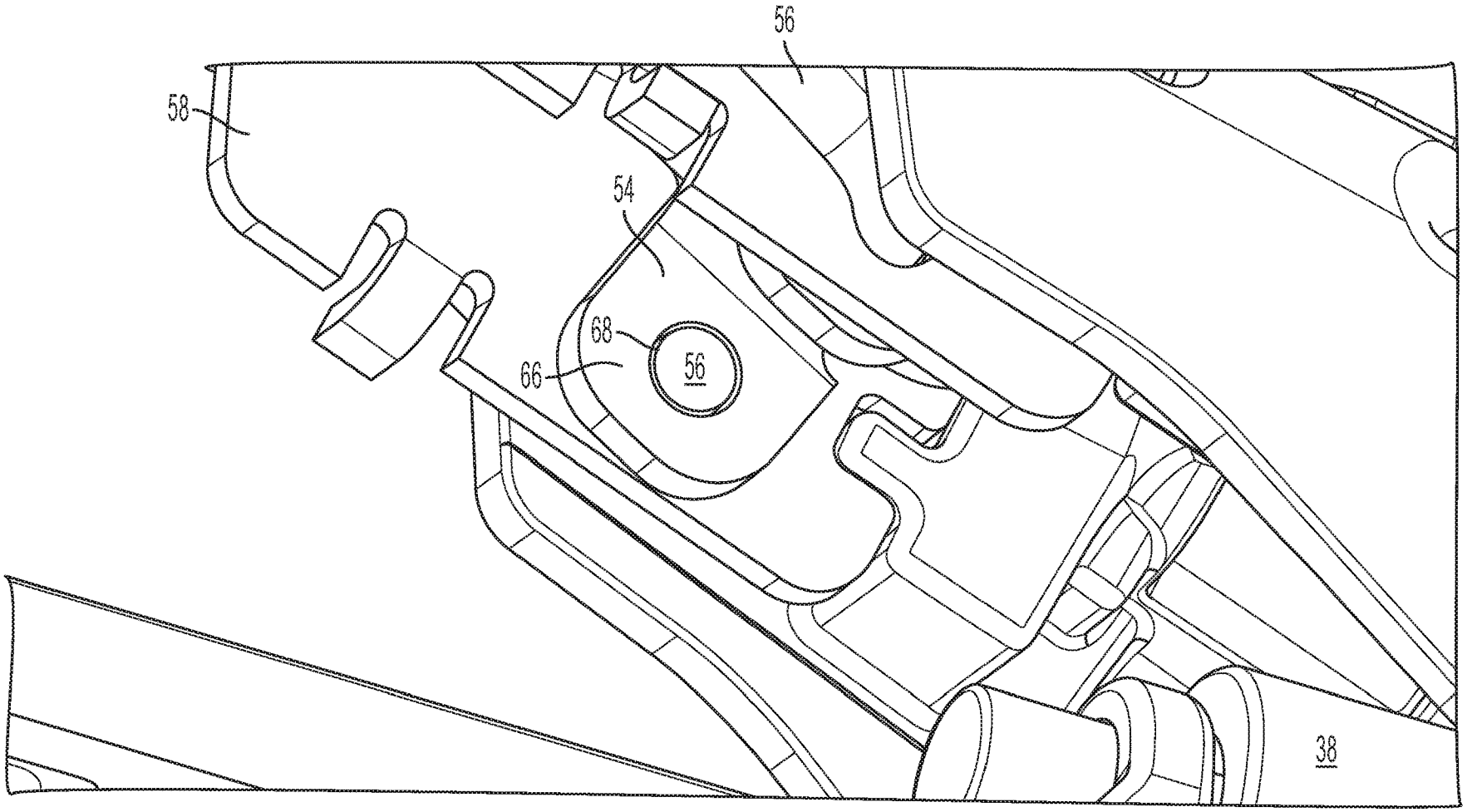
FIG. 6 is an enlarged view of the latch member and latch plate connection.
Figure 7:
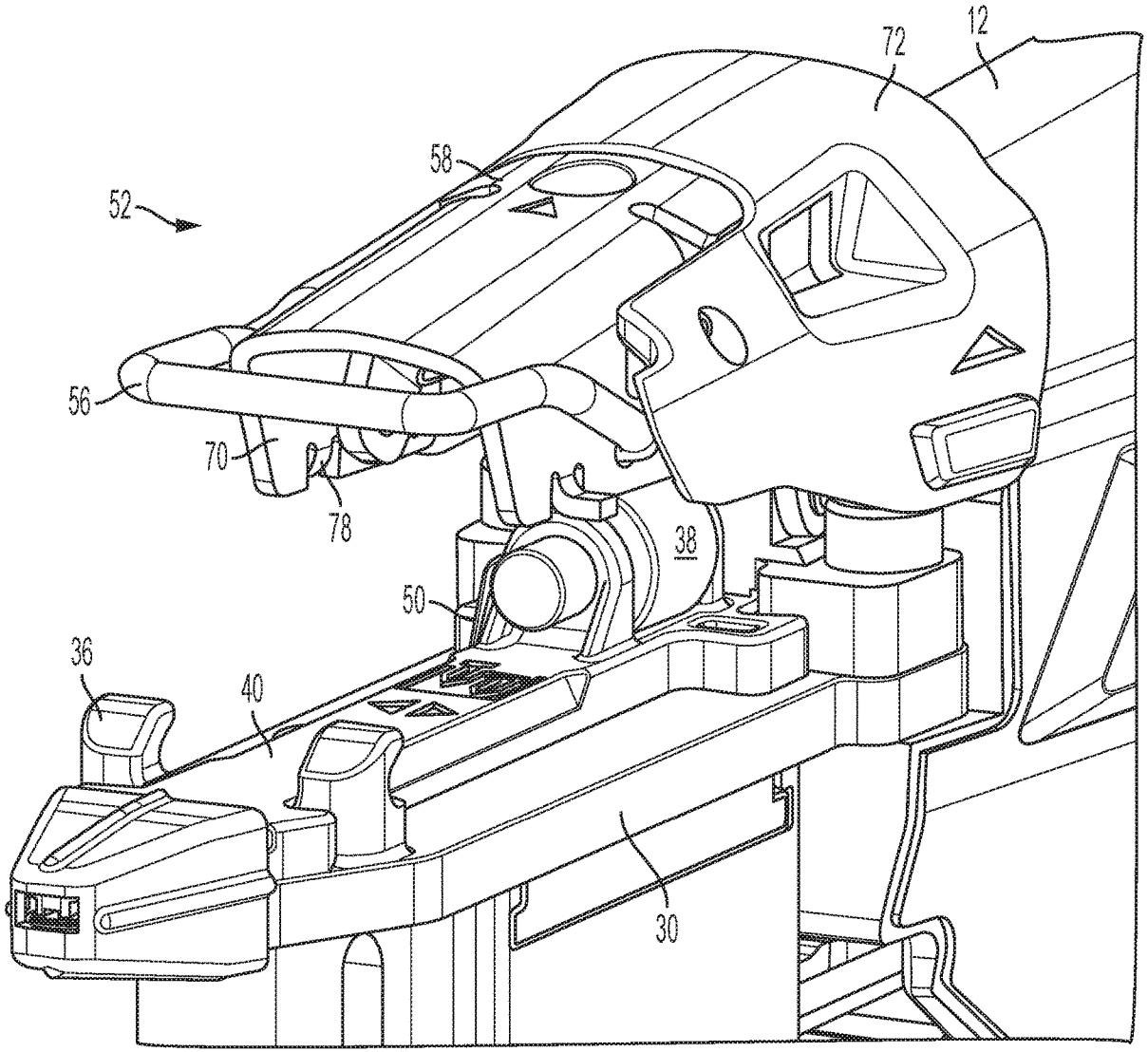
FIG. 7 is a top perspective view of the nosepiece assembly and latch mechanism of the fastening tool of FIG. 1.

With reference to FIGS. 5, 6 and 7, the latch member 56 is pivotally coupled to the latch cover 58, through the same apertures 68 in the latch plate 54.

Figure 8:
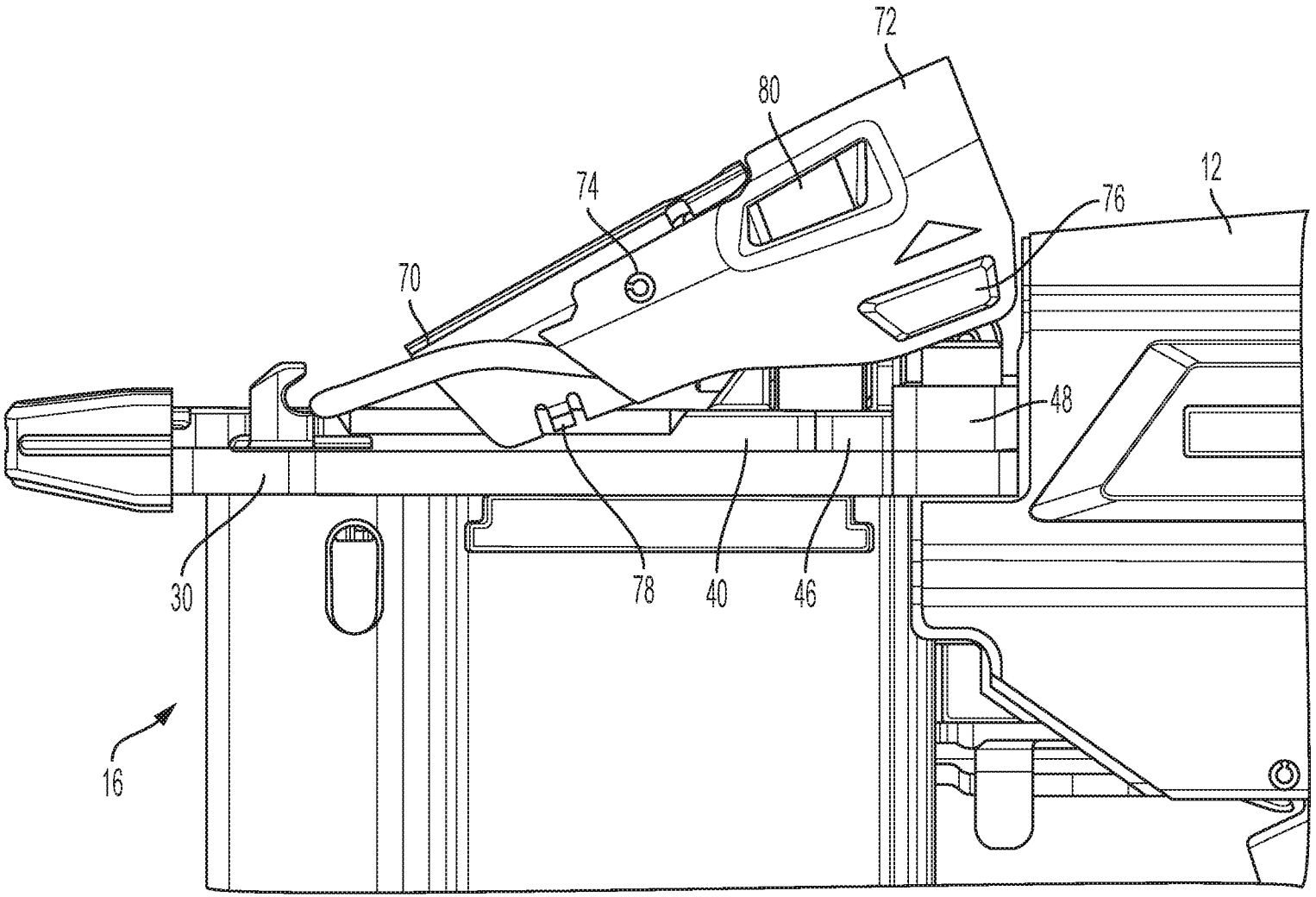
FIG. 8 is a side view of the nosepiece assembly with the latch mechanism in an unlatched position.
Figure 9:
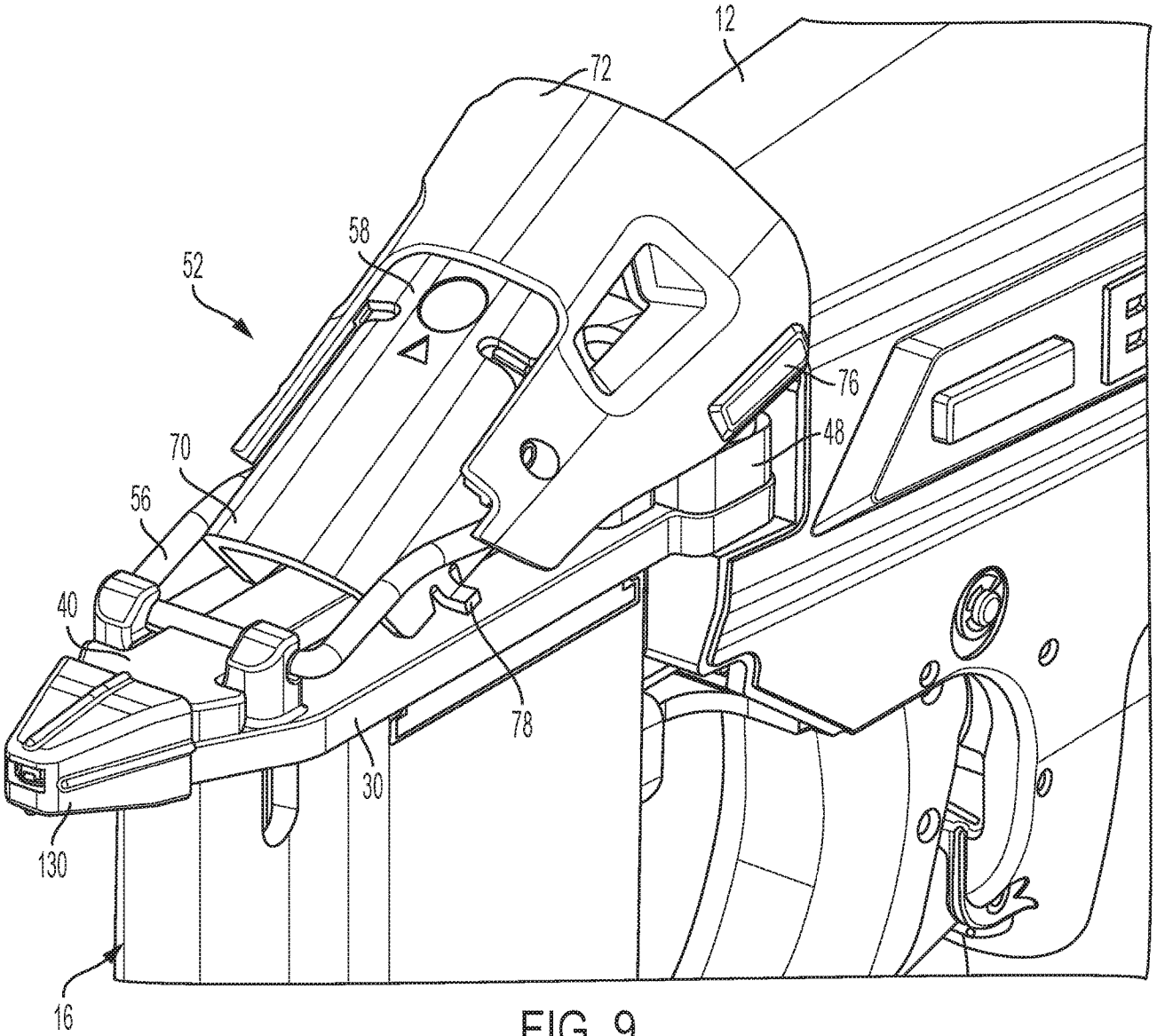
FIG. 9 is a top perspective view of the nosepiece assembly with the latch mechanism in an unlatched position.

In an embodiment, the latch member 56 is formed from a metal and has a resilient body. As shown in FIGS. 7, 8 and 9, a center portion of the latch member 56 is engageable with the hooks 36. The latch member 56 is pivotally supported on the latch plate 54 for spring biased releasable engagement with the hooks 36 thereby latching the latch plate 54 on the nose portion 30. It should be appreciated that various other shaped wires or clips 56 may be employed.

The latch cover 58 can be formed as a rigid body. In an embodiment, illustrated in FIGS. 7, 8 and 9, the latch cover 58 can have a forward portion 70 and a rearward portion 72. The forward portion 70 can be formed from a first material and the rearward portion 72 can be formed from a second material where the first material is different from the second material. For example, the first material can be a metal and the second material can be a plastic. Alternatively, the first and second materials can be two distinct kinds of plastic. In another embodiment, the first material can be the same as the second material. Alternatively, the rigid body can be formed from metal alone.

The forward 70 and rearward 72 portions can be fixed together, such as by being coupled to each other by spring pins 74, as shown in FIG. 8. In a further embodiment, the latch cover 58 can be integrally molded or forged as a single piece of the same material.

In an embodiment where the forward portion 70 is formed from a metal, and the rearward portion 72 is formed from plastic, the metal provides structural rigidity and the plastic provides a cover for a smooth appearance of the front of the tool as well as providing a grasping point for the user to easily lift the latch cover 58 with their fingers. In this regard, the latch mechanism 52 is user friendly and allows the user to open the nosepiece without the use of tools.

In an embodiment, the latch cover 58 can also include a gripping section 76 that defines a location for the user to place their fingers for grasping and lifting the latch cover 58. The gripping section 76 facilitates movement of the latch member 56 from engagement with the pair of hooks 36 to disengagement from the pair of hooks, thereby facilitating movement of the latch mechanism from the latched position to the unlatched position. Lifting the latch cover exposes the door 40 and nose portion 30 and allows the user to remove a fastener that is jammed in the fastener drive track 26. In an embodiment, the gripping section 76 can be a protruding member. In another embodiment, the gripping section can be a substantially planar textured or ribbed surface. In a further embodiment, the gripping section 76 can be a protruding member having a textured or ribbed surface. In an embodiment, the gripping section 76 can be disposed on the rearward portion 72 of the latch cover 58.

The forward portion 70 of the latch cover 58 includes stoppers 78 on opposite lateral sides. The stoppers 78 project outwardly to prevent the latch member 56 from swinging toward the nose portion 30 when the latch mechanism 52 is unlatched, such as when the latch member 56 is disengaged from the pair of hooks 36.

The rearward portion 72 of the latch cover 58 includes a window 80 therethrough for indicating the presence of the depth adjustment wheel 38. The depth adjustment wheel 38 can be accessed when the latch cover 58 is opened.

In operation, when the latch member 52 is in a latched position over the nose portion 30, the latch member 56 is received firmly within the hooks 36 of the nose portion 30. This is due to the latch member 56 having a bend along its longitudinal length. Thus, the length of the latch member 56 is longer than the longitudinal distance the latch member 56 covers along the nosepiece. As a result, the latch member 56 provides a mechanical advantage for tightening the interface between the latch mechanism 52 and the nose portion 30. In the latched position, the center portion of the latch member 56 presses firmly down upon and across the door 40. This arrangement ensures that, in the latched position, the door 40 is secured against the nose portion 30.

Also, in the latched position the latch cover 58 is separated from the housing 12 by a gap 82 (FIG. 2), which gives the latch cover space to pivot when the latch mechanism 52 is in the unlatched position.

To release the door 40, the latch cover 58 is urged away from the door 40, for example, by the user pulling up on the projecting member 76. Urging the latch cover 58 away from the door 40 disengages the latch member 56 from the hooks 36, thus allowing the door 40 to pivot about the projecting lip 49 of the door plate 48 and away from the nose portion 30. In the unlatched position, the user may then clear any jammed fastener from within the nosepiece assembly 24 by pulling the fastener along the longitudinal length of the nose portion 30 toward the nose tip.

Although a wire latch member, as illustrated, can be used to attach the cover to the nosepiece structure, any other element that can connect the latch cover to a nosepiece structure can be used. Lifting the rearward portion 62 of the latch cover releases the bias of the spring in the latched state. As a result, the latch cover 58 can be raised off the nose portion 30 of the nosepiece assembly 24.

While aspects of the present invention are described herein and illustrated in the accompanying drawings in the context of a fastening tool, those of ordinary skill in the art will appreciate that the invention, in its broadest aspects, has further applicability.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made, and equivalents may be substituted for elements thereof without departing from the scope of the present disclosure. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and claims.

We claim:

1. A fastening tool comprising:

a housing;

a nosepiece assembly carried by the housing, the nosepiece assembly including a nose portion having first end adjacent to the housing and a second end opposite to the housing, a pair of hooks integrally formed on the nose portion, a door arranged opposite the nose portion and a fastener drive track disposed therebetween;

a magazine for feeding fasteners successively to the fastener drive track of the nosepiece assembly;

an engine carried by the housing and configured to drive a fastener out of the fastener drive track and into a workpiece during a drive stroke; and a latch mechanism arranged to cover the nosepiece assembly, the latch mechanism including:

a latch cover;

a latch plate disposed between the latch cover and the door; and a latch member connecting the latch plate to the latch cover, wherein the pair of hooks are disposed on opposite lateral sides of the nose portion, each hook being open toward the housing.

2. The fastening tool according to claim 1, wherein the door is disposed between the pair of hooks.

3. The fastening tool according to claim 1, wherein the nosepiece assembly further comprises a door plate mounted on the first end of the nose portion.

4. The fastening tool according to claim 3, wherein one end of the door is sandwiched between the door plate and the nose portion and is movable with respect to the nose portion.

5. The fastening tool according to claim 1, wherein the latch mechanism is disposed along the longitudinal length of the nosepiece assembly.

6. The fastening tool according to claim 1, wherein the latch mechanism is operatively connected to arranged to cover at least a portion of the nosepiece assembly.

7. The fastening tool according to claim 1, wherein the latch mechanism has a latched position and an unlatched position.

8. The fastening tool according to claim 7, wherein in the latched position the latch member engages the pair of hooks and in the unlatched position, the latch member is disengaged from the pair of hooks.

9. The fastening tool according to claim 7, wherein in the latched position, the latch member exerts an outward force against the pair of hooks in the direction toward the second end of the nose portion.

10. The fastening tool according to claim 7, wherein in the latched position, engagement of the latch member and the pair of hooks creates a compressive stress on the latch mechanism.

11. The fastening tool according to claim 7, wherein the latch cover further comprises a gripping section for facilitating movement of the latch mechanism from the latched position to the unlatched position.

12. The fastening tool according to claim 1, wherein the latch member comprises a Wlfe.

13. The fastening tool according to claim 1, wherein the latch plate comprises a pair of forward flanges through which the latch member connects the latch plate to the latch cover and a pair of rear flanges for pivotally connecting the latch plate to the door plate.

14. The fastening tool according to claim 1, wherein the latch cover is formed as a rigid body.

15. The fastening tool according to claim 14, wherein the rigid body is formed from a first material and a second material different from the first material.

16. The fastening tool according to claim 15, wherein at least one of the first material and second material is plastic.

17. A nosepiece latch mechanism for a fastening tool comprising: a latch cover; a latch plate disposed on one side of the latch cover; a latch member pivotally connecting the latch plate to the latch cover; and at least one stopping member projecting outwardly from the latch cover, the at least one stopping member engageable with the latch member, wherein the latch cover comprises a top portion and opposing lateral side portions and the at least one stopping member projects outwardly from each of the opposing lateral side portions.

18. A fastening tool comprising:

a housing;

a nosepiece assembly carried by the housing, the nosepiece assembly including a nose portion having first end adjacent to the housing and a second end opposite to the housing through which a fastener is ejected, a pair of hooks integrally formed on the nose portion, a door arranged opposite the nose portion and a fastener drive track disposed therebetween;

a magazine for feeding fasteners successively to the fastener drive track of the nosepiece assembly;

an engine carried by the housing and configured to drive a fastener out of the fastener drive track and into a workpiece during a drive stroke; and a latch mechanism arranged to cover the nosepiece assembly, the latch mechanism including:

a latch cover;

a latch plate disposed between the latch cover and the door; and a latch member connecting the latch plate to the latch cover, wherein the latch mechanism has a latched position and an unlatched position, and wherein in the latched position, the latch member exerts an outward force against the pair of hooks in a direction toward the second end of the nose portion.

* * * * *